US005595558A

United States Patent [19]

Moon

[11] Patent Number: 5,595,558

[45] Date of Patent: Jan. 21, 1997

[54] EXERCISER

[76] Inventor: Daniel R. Moon, 148 Maplewood, Riverside, Ill. 60546

[21] Appl. No.: 541,302

[22] Filed: Oct. 10, 1995

[51] Int. Cl.[6] ..... A63B 21/00

[52] U.S. Cl. ..... 482/72; 482/130; 482/95; 472/95

[58] Field of Search ..... 472/95, 101, 103, 472/113, 100, 126; 297/281, 282, 273; 482/72, 95, 96, 130, 121

[56] References Cited

U.S. PATENT DOCUMENTS

| | | | |
|---|---|---|---|
| 208,531 | 1/1878 | Margua | 472/95 |
| 281,282 | 7/1883 | Menuez . | |
| 329,653 | 1/1885 | Kitchen | 482/130 |
| 383,808 | 5/1888 | Hall . | |
| 1,275,757 | 8/1918 | Rosenberg | 482/130 |
| 1,469,674 | 10/1923 | Moss . | |
| 1,507,613 | 9/1924 | Milky . | |
| 1,544,187 | 6/1925 | Schroeder . | |
| 1,766,840 | 6/1930 | Rose | 297/282 |
| 2,044,862 | 6/1936 | Smith | 297/281 |
| 2,145,940 | 2/1939 | Marlowe . | |
| 2,544,106 | 3/1951 | Ray | 472/110 |
| 3,047,334 | 7/1962 | Vandermiden . | |
| 3,730,585 | 5/1973 | Rogers, Jr. et al. . | |
| 4,108,415 | 8/1978 | Hauray et al. . | |
| 4,591,205 | 5/1986 | James . | |
| 4,629,185 | 12/1986 | Amann . | |
| 4,700,920 | 10/1987 | Horn . | |
| 4,736,944 | 4/1988 | Johnson et al. . | |
| 4,756,523 | 7/1988 | Rasmussen . | |

FOREIGN PATENT DOCUMENTS

| | | | |
|---|---|---|---|
| 0496740 | 2/1937 | United Kingdom | 482/130 |

*Primary Examiner*—Jerome Donnolly
*Attorney, Agent, or Firm*—Marshall, O'Toole, Gerstein, Murray & Borun

[57] ABSTRACT

This disclosure relates to a rower-type exerciser comprising a support base, a seat, and pivot links connecting the seat with the base to produce a glider-type rocking motion. A resistance device is connected between the parts to resist or restrain the rocking motion. Force arms are attached to the links to enable an operator on the seat to induce the rocking motion, and a foot brace is attached to the support base to enable the operator to brace the feet and/or push or pull forward with footstraps in place against the brace to further induce the rocking motion. The user can emphasize force contributions of either the user's top extremities or lower extremities to the rocking motion inducing forces.

16 Claims, 8 Drawing Sheets

EXERCISER

FIELD AND BACKGROUND OF THE INVENTION

This invention relates generally to exercise machines, and more specifically to a rower-type exerciser.

Exerciser machines are well known and in recent years have come into fairly widespread use. The following U.S. patents, for example, show various types of exercisers:

| | | |
|---|---|---|
| H. J. Marlowe | 2,145,940 | 02-07-39 |
| M. J. Amann | 4,629,185 | 12-16-86 |
| J. B. Johnson et al. | 4,736,944 | 04-12-88 |
| R. A. Rasmussen | 4,756,523 | 07-12-88 |

The users of such machines usually have as their goal the achievement of a certain level of fitness, such as cardiovascular fitness, muscular fitness and/or an overall appearance of health and fitness. These goals, while generally desirable, have led many people to purchase exercise machines which often are poorly designed and/or require an excessive amount of effort. As a result, in some instances physical injuries have resulted through misuse. Probably the most common criticism of such machines is that they are boring and difficult to use, and as a consequence, they are neglected after an initial period of use.

It is a general object of the present invention to provide an improved full body exercise machine which is intuitively and comfortably used and attractive to a broad range of operator's abilities.

SUMMARY OF THE INVENTION

This invention relates to a rower-type exerciser comprising:

a) a stationary base having forward and rearward ends and two lateral sides, the base including first and second laterally spaced upwardly extending base supports;

b) a seat including seat supports;

c) first and second sets of links, each of said sets including a forward link and a rearward link and each of said links including an upper end portion and a lower end portion;

d) first pivot means for pivotably attaching said upper end portions to said base supports;

e) second pivot means for pivotably attaching said lower end portions to said seat supports;

f) at least one force arm attached to at least one of said forward links and extending forwardly of said seat to a location where it may be grasped by a person mounted on said seat to produce a swinging motion of said seat relative to said base, said exerciser including at least two portions which move relative to each other during said swinging motion; and g) a resistance device connected between said two portions for resisting said swinging motion.

The exerciser preferably further includes a foot brace attached to the stationary base and extending forwardly of said seat, and the seat preferably includes a back support.

BRIEF DESCRIPTION OF THE DRAWINGS

The invention will be better understood from the following detailed description taken in conjunction with the accompanying figures of the drawings, wherein.

DETAILED DESCRIPTION OF THE INVENTION

Figure 1:
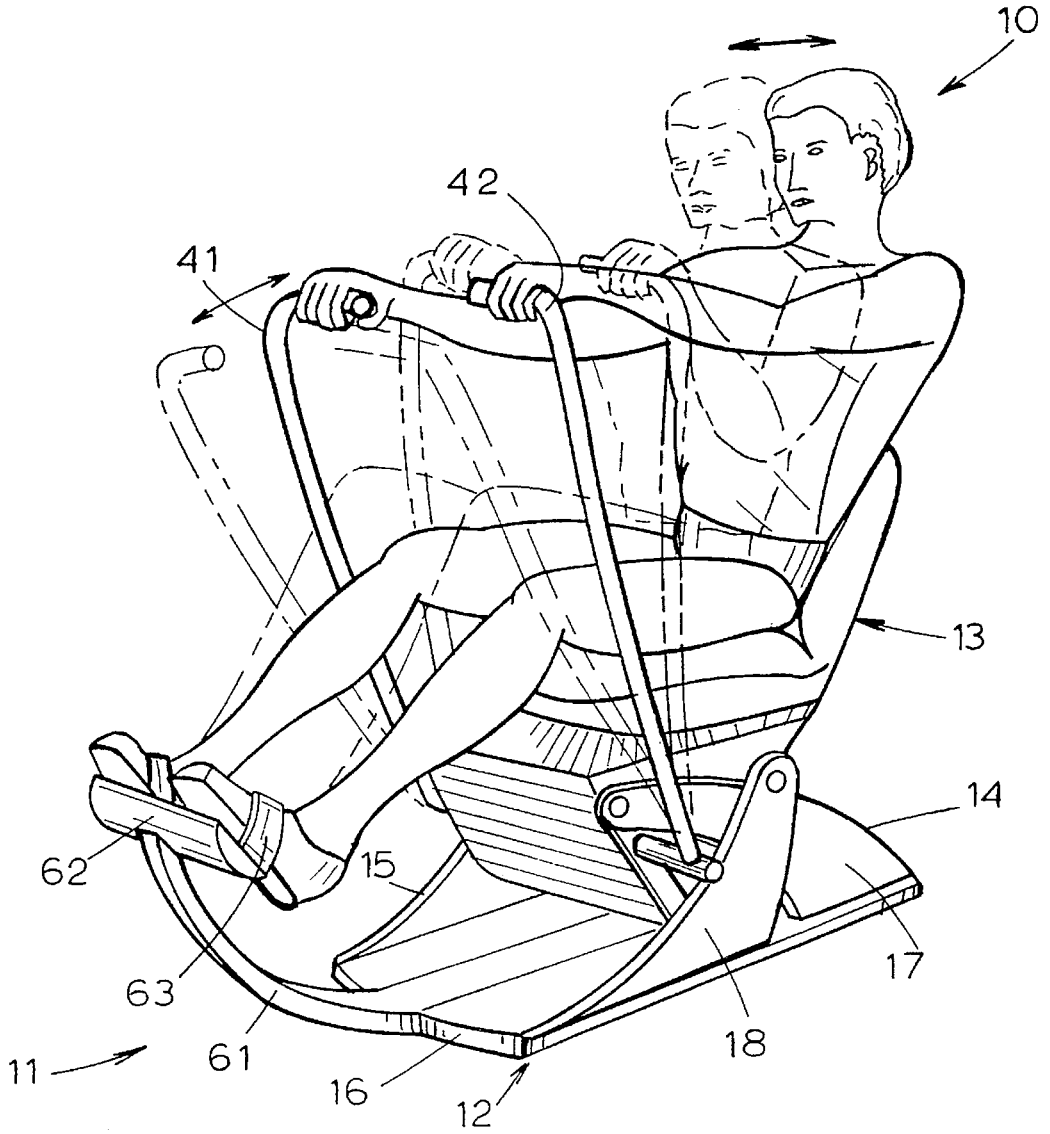
FIG. 1 is a perspective view showing an exerciser constructed in accordance with the present invention, when in use by an operater.

With reference first to FIG. 1 of the drawings, the numeral 10 illustrates an operator seated on and operating an exerciser 11 constructed in accordance with the present invention. The exerciser 11 includes a base 12 which is normally positioned and supported on a generally horizontal support surface such as a floor or other support surface 19 (FIG. 2) when in use, and a seat 13 which is supported on the base 12 in the manner described hereinafter. The base 12 includes laterally spaced, upwardly extending base supports 14 and 15 and, in the present instance, a bottom plate 16 which rests on the support surface 19 and connects the lower edges of the two base supports 14 and 15. While the base supports 14 and 15 may take various shapes, in the present instance each base support includes two upwardly curved portions 17 and 18 (see especially FIG. 2).

Figure 3:
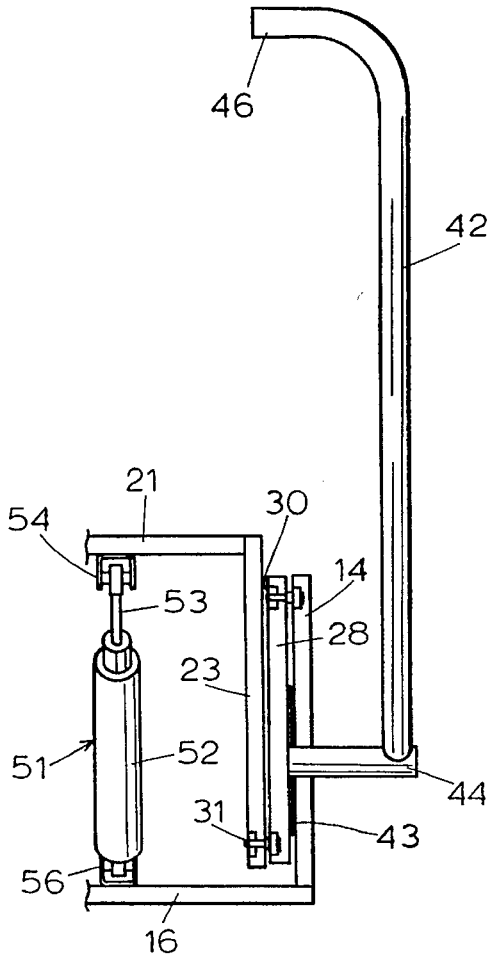
FIG. 3 is a partial front elevational view.

The seat 13 includes a seat portion 21 and a back support or back rest 22. The seat portion 21 is located at a comfortable level above the floor surface 19 and may be on a similar level to that of a ordinary chair. Preferably the seat portion 21 and the back support 22 are contoured and cushioned to be comfortable and to provide good lumbar support for the operator 10 while exercising. Depending downwardly from each side of the seat portion 21 is a seat support 23, and the seat supports are spaced laterally inwardly slightly from the two base supports 14 and 15. While FIG. 3 shows only one seat support 23 and one base support 14, it will be understood that two laterally spaced seat supports and two laterally spaced base supports are provided.

Figure 2:
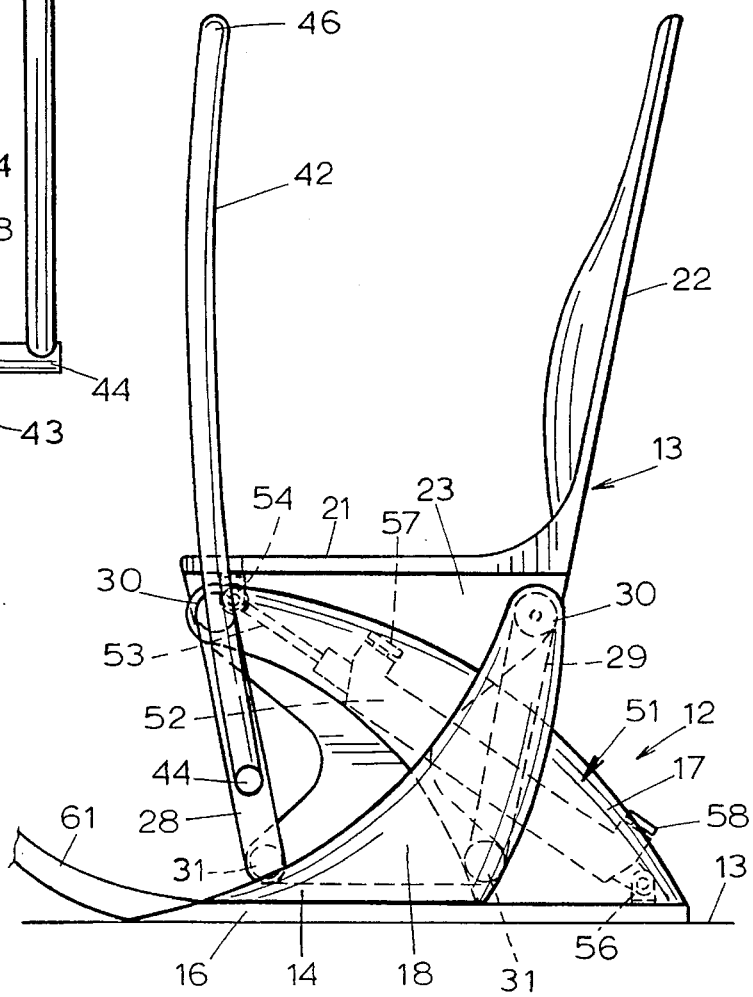
FIG. 2 is a side elevational view of the exerciser.

The seat 13 is mounted on the base 12 for swinging movement generally in the manner of a "glider" rocking chair. In the structure illustrated in FIGS. 1 to 5, the seat is suspended from two identical sets of links, one set being at each side of the seat. With reference to FIG. 2 which shows one set, the set includes a forward link 28 and a rearward link 29. Pivot devices 30 are provided for connecting the upper ends of the links 28 and 29 to the upper portions of the base supports 14 and 15. The links 28 and 29 of each set extend downwardly from the pivot devices 30; while this is not an essential feature of this invention, the links also angle downwardly and toward each other slightly as illustrated in FIG. 2. The lower ends of the links 28 and 29 are connected by additional pivot devices 31 to the lower end portions of the seat supports 23. Thus the links 28 and 29 may pivot about their upper end portions on the pivot devices 30, and the two seat supports 23 swing with the lower ends of the two sets of links 28 and 29 due to the pivot devices 31.

With reference to the neutral position shown in FIG. 2, the two forward links 28 angle downwardly and slightly toward the rear from a vertical plane through the forward pivot devices 30, and the two rearward links 29 angle downwardly and slightly toward the front from a vertical plane through the rearward pivot devices 30. Each pivot device 30 and 31 on each side of the seat is coaxial with the correspondingly located pivot device on the other side of the seat during the swinging motion.

Figure 4:
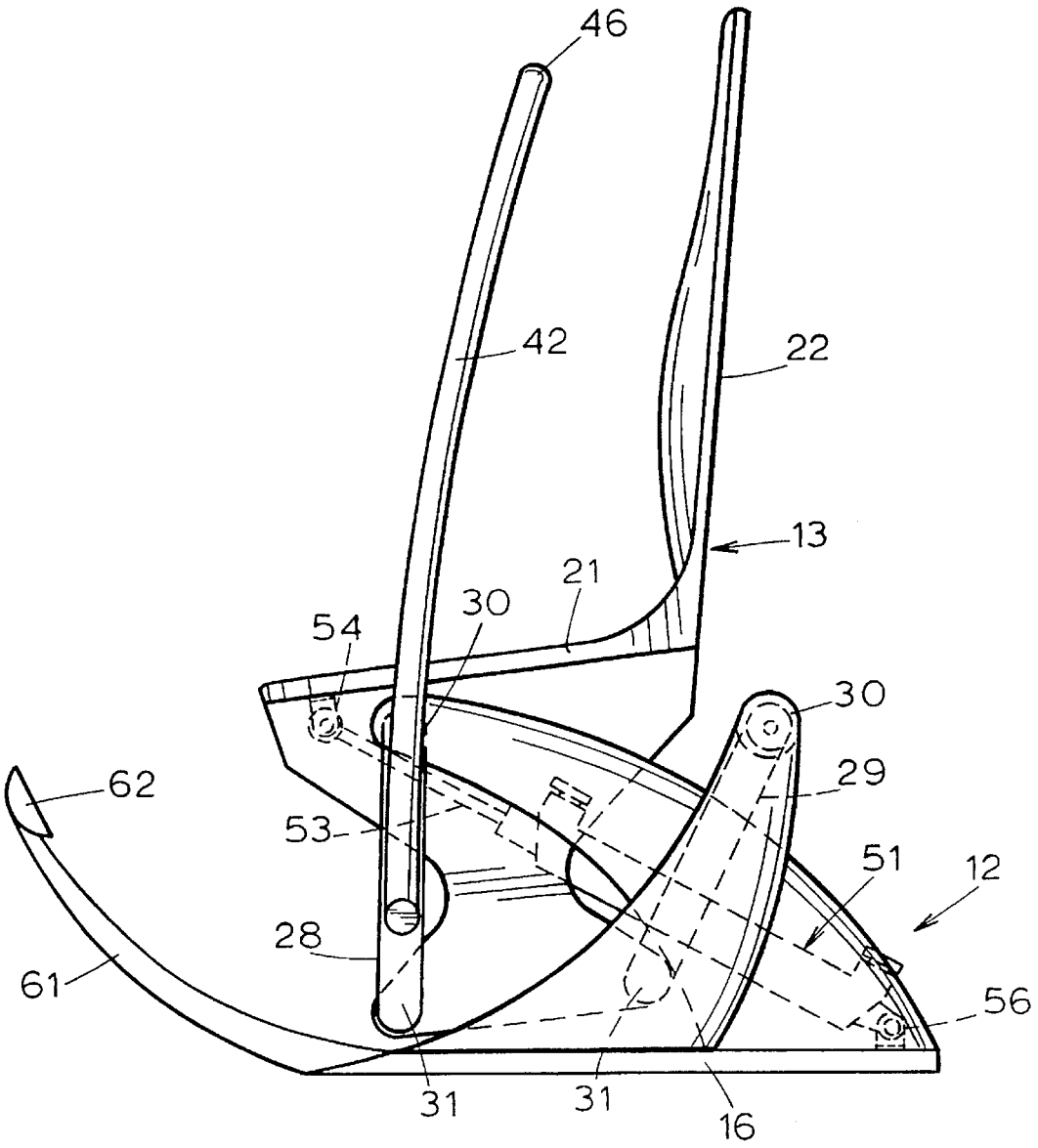
FIG. 4 is a view similar to FIG. 2 but showing different positions of some of the parts.
Figure 5:
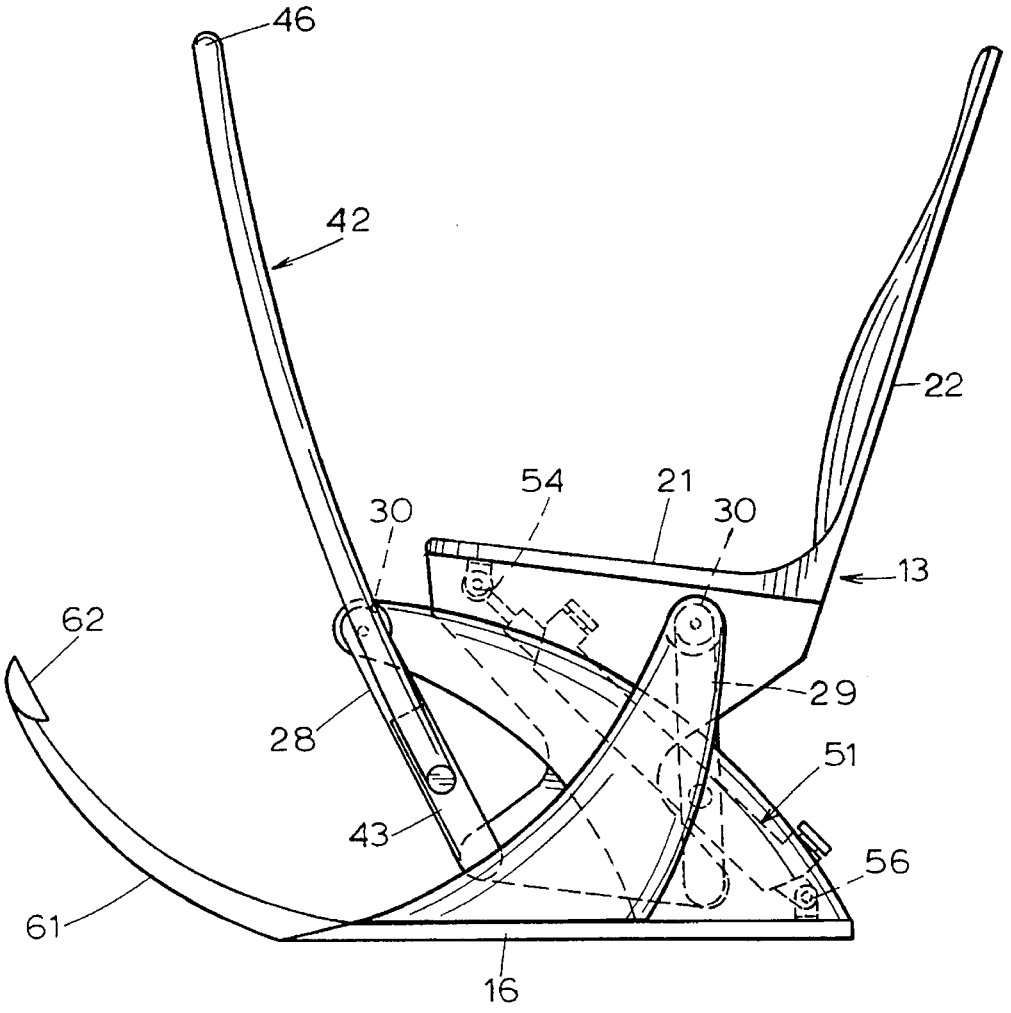
FIG. 5 is still another view similar to FIG. 2 but showing still another position of the parts.

FIG. 2 illustrates what may be termed the "neutral position" of the links 28 and 29 and the seat 13, and this neutral position exists when there are no external forces tending to swing the seat 13. FIG. 4 illustrates the positions of the links and the seat 13 when the seat base 21 is moved forwardly relative to the support base 12, and FIG. 5 illustrates positions of the links and the seat 13 when the seat is moved rearwardly relative to the base 12. Because, in the example of the invention illustrated in FIGS. 1 to 5, the links 28 and 29 of each set have their lower ends angled toward each other when in the neutral position, movement of the seat forwardly as shown in FIG. 4 causes the bottom end of the forward link 28 to swing downwardly somewhat and forwardly whereas the lower end of the other link 29 swings forwardly and upwardly slightly, thereby causing the seat 21 to tip forwardly and upwardly as is shown in FIG. 4. Conversely when the seat is moved rearwardly as shown in FIG. 5, the rear of the seat base 21 swings downwardly and rearwardly whereas the forward portion of the seat swings upwardly and rearwardly, thereby causing the seat to tilt rearwardly slightly. As a consequence, the seat 13 swings relative to the base 12 in a manner somewhat similar to that of a "glider" rocking chair mechanism.

As best illustrated in FIG. 1, a pair of force arms 41 and 42 are secured to the two forward links 28 of the two sets of links. From the forward links, the two force arms 41 and 42 extend upwardly and forwardly from the forward edge of the seat 21. The two arms 41 and 42 have their lower ends firmly secured to the two links 28, by, for example, plates 43 (FIG. 3) which are secured to the links 28 and to the support arms 41 and 42. In the present specific example illustrated in the drawings, horizontally extending stub shafts 44 are firmly secured to the plates 43, and the force arms 41 and 42 are secured to the stub shafts 44. For the comfort of the operator 10, the upper ends of the two force arms 41 and 42 are turned laterally inwardly toward each other as best illustrated in FIGS. 1 and 3 and the handles 46 are located at a position where they may be comfortably gripped by the operator 10.

As will be apparent from the drawings, an operator 10 seated on the seat 21 may grasp the handles 46 and either pull them toward his shoulders or push them away by straightening his arms. FIG. 1 shows one position in full lines and a second position in phantom lines. When the handles are pulled rearwardly, the lower ends of the force arms 41 and 42 swing the forward links 28 such that their lower end portions swing forwardly as shown in FIG. 4. On the other hand, when the operator straightens his arms and pushes the handles 46 away from his shoulders, the lower ends of the forward links 28 are swung toward the rear of the base, as shown in FIG. 5.

A resistance device 51 is provided to restrain or resist the swinging movement of the seat described above, in order to force the operator to exert a certain amount of effort in order to produce the swinging motion. While the resistance device may be connected between any two parts of the exerciser which exhibit relative movement toward and away from each other during operation of the exerciser, in the present example, the resistance device 51 is connected between the rearward portion of the bottom plate 16 and the forward portion of the underside of the seat portion 21. In the specific example described herein, the resistance device 51 includes a cylinder 52 and a piston rod 53 that moves into and out of the cylinder 52. The outer end of the piston rod 53 is attached by a pivot mechanism 54 to the underside of the seat portion 21 at approximately its center, as illustrated in FIGS. 2 and 3. The rearward end of the cylinder 52 is attached by another pivot device 56 to the center rearward portion of the bottom plate 16 of the base 12. The cylinder 52 may be a conventional device including mechanism within the cylinder 52 for resisting movement of the rod 53 both into and out of the cylinder 52. The cylinder 52 may include adjustment means 57 and 58 for varying the amount of resistance to the motion, and the devices 57 and 58 may be adjusted such that the amount of energy or force required to move the seat in one direction is different from that required to move the seat in the other direction.

Still further, the exerciser preferably includes a foot brace attached to the base 12. In the present instance, the foot brace includes a support arm 61 which extends upwardly and forwardly from the forward side of the bottom plate 16. The support arm 61 further includes a cross bar 62 secured to the forward end of the arm 61 at a location which allows the operator 10 to brace his feet. Straps 63 may be provided on the cross bar 62 to assist the operator in pulling the seat toward the cross bar and to help the operator maintain his feet properly located on the cross bar 62.

The construction and operation of the exerciser may be briefly summarized as follows. Normally the seat 13 is in the neutral position shown in FIG. 2, and the operator 10 places himself on the seat with his lower back firmly against the back rest 22. The operator then places his feet on the cross bar 62, within the straps 63, and then grasps the two handles 46. The operator then initiates operation of the exerciser by pulling or pushing on the handles 46 and/or pushing the feet against the cross bar 62. To simulate a rowing operation, the operator may pull on the handles 46 and simultaneously brace his feet against the cross bar 62. As the operator pulls on the handles 46, the rod 53 is extended out of the cylinder 52 against the action of the internal resistance mechanism, thereby requiring the operator to exert a given amount of effort to achieve the position shown in FIG. 4. After moving the seat 13 to the position shown in FIG. 4, the operator would then press with the feet to push the cross bar 62 away and the operator may also push the handles 46. The resistance device 51 again requires effort to move in this direction to achieve the position shown in FIG. 5. The operator moves back and forth between these positions and must exert force in both directions. It will be apparent that the operator's arms, shoulders, back and legs will all be exercised by the foregoing movements.

The amount of force required to overcome the resistance device 51 may be adjusted to a relatively low level if desired to accommodate a person who desires only a moderate amount of exercise while comfortably sitting in the seat 13. On the other hand, a person desiring a more strenuous workout may adjust the resistance device 51 to require a greater amount of effort. The exerciser does not require a great deal of space and the operator may be comfortably seated and have a good back support. The seat position ergonomics permit the operator to comfortably engage in diversions, such as television.

FIGS. 6–9 illustrate an exerciser having a modified structure but having the same principles of operation.

Figure 6:
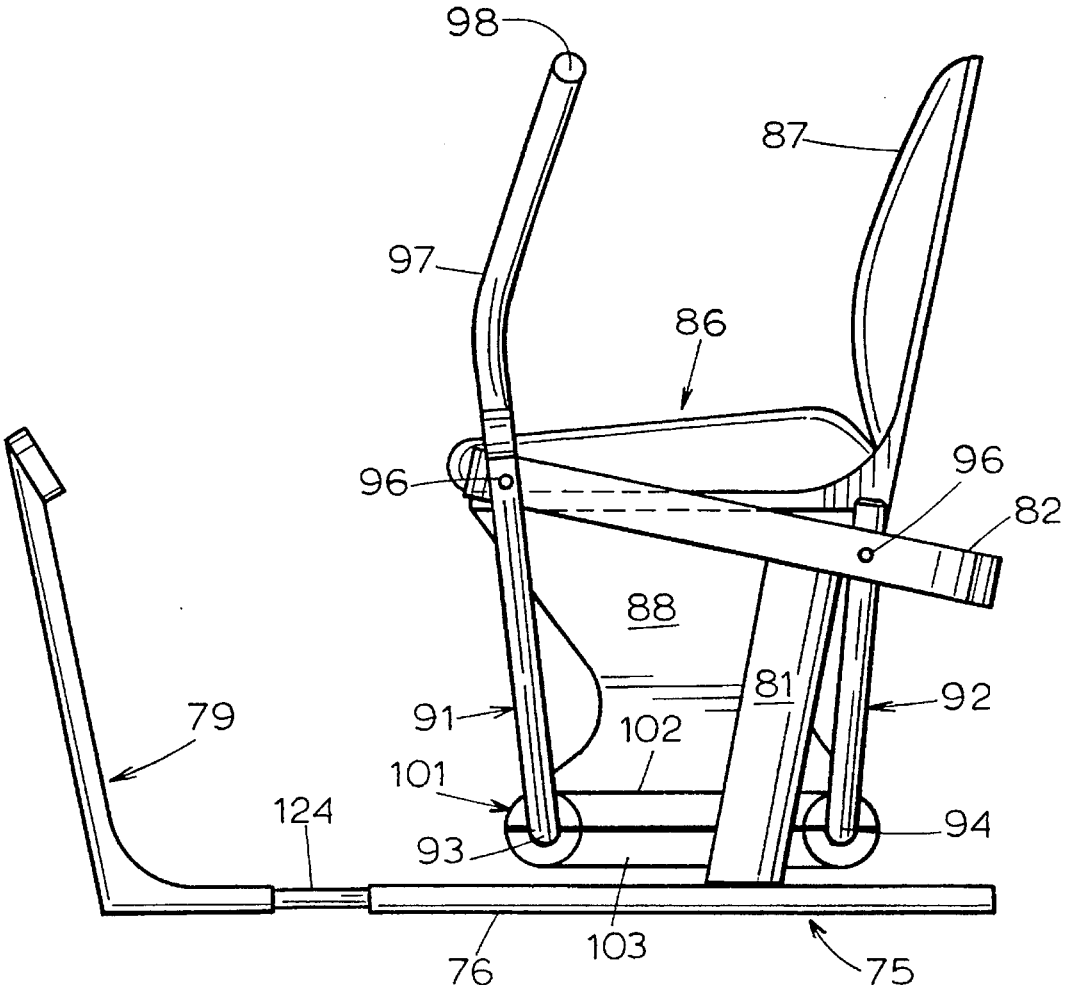
FIG. 6 is a side elevational view showing an alternative embodiment of this invention.
Figure 7:
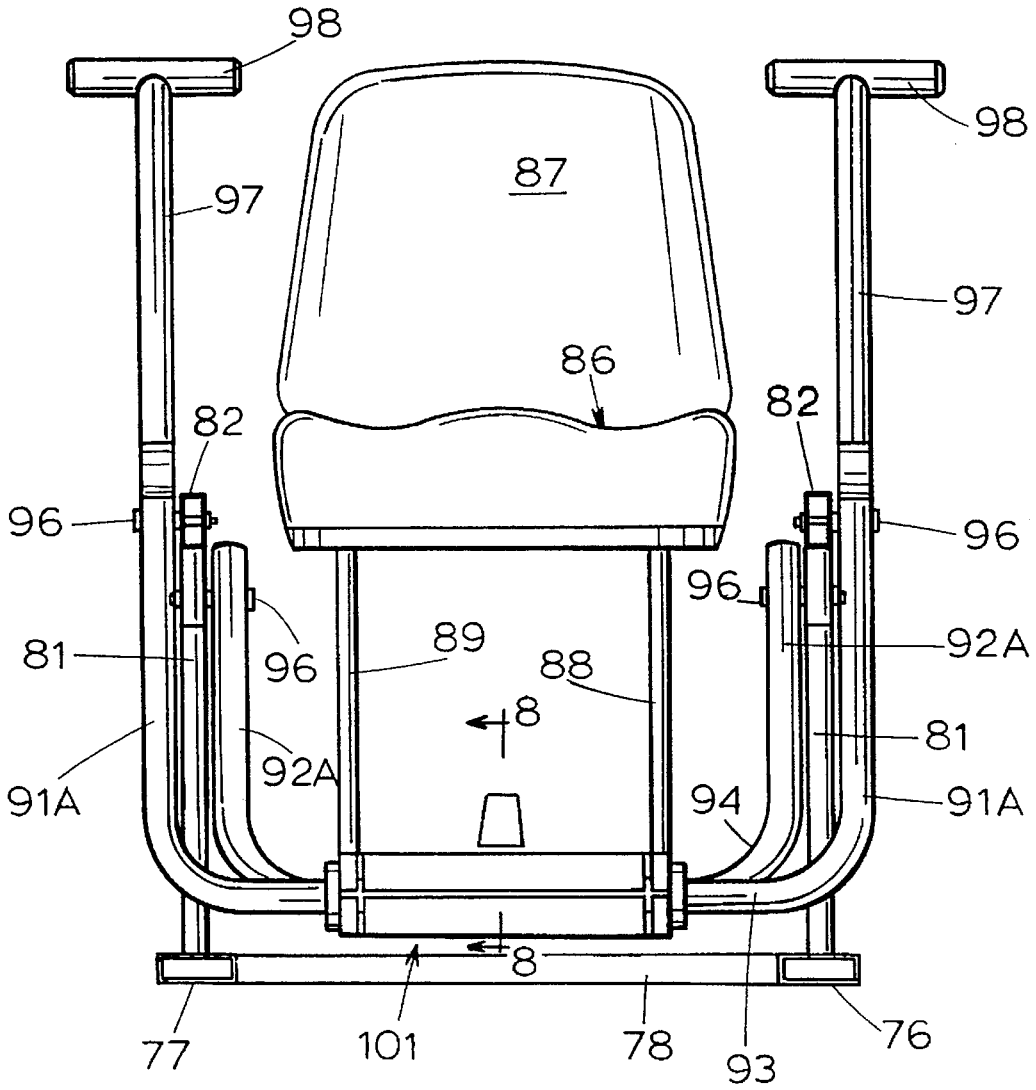
FIG. 7 is a front elevational view of the embodiment of FIG. 6.

With reference first to FIGS. 6 and 7, a base 75 is formed by two elongated feet 76 and 77 connected by a cross brace 78. A foot brace 79 extends forwardly and upwardly from the feet 76 and 77. At each side of the base, an upright support 81 extends upwardly from the feet 76 and 77, and an upper support 82 extends forwardly and rearwardly from the upper end of each upright support 81.

A seat 86 having a back support 87 is mounted on two laterally spaced, vertically extending seat supports 88 and 89. The seat 86 and back support 87 are preferably cushioned and contoured to form a comfortable and adequate support.

The seat supports 88 and 89 are pivotably supported from the upper supports 82 by forward and rearward pivot links 91 and 92. Each of the links is U-shaped as shown in FIG. 7, and the center portions 93 and 94 extend horizontally adjacent the lower edges of the seat supports 88 and 89. The links 91 and 92 angle upwardly to the upper supports 82 and the vertical arms 91A and 92A are connected to the supports by pivot pins 96.

Force arms 97 extend upwardly from the upper ends of the forward link 91 and may be formed integrally with them. Handles 98 are preferably attached to the upper ends of the arms 97. The links 91 and 92 and the arms 97 are preferably formed of metal tubes. As best illustrated in FIG. 7, the vertical arms 91A are on the laterally outer sides of the supports 82 and the vertical arms 92A are on the laterally inner sides of the supports 82.

Figure 8:
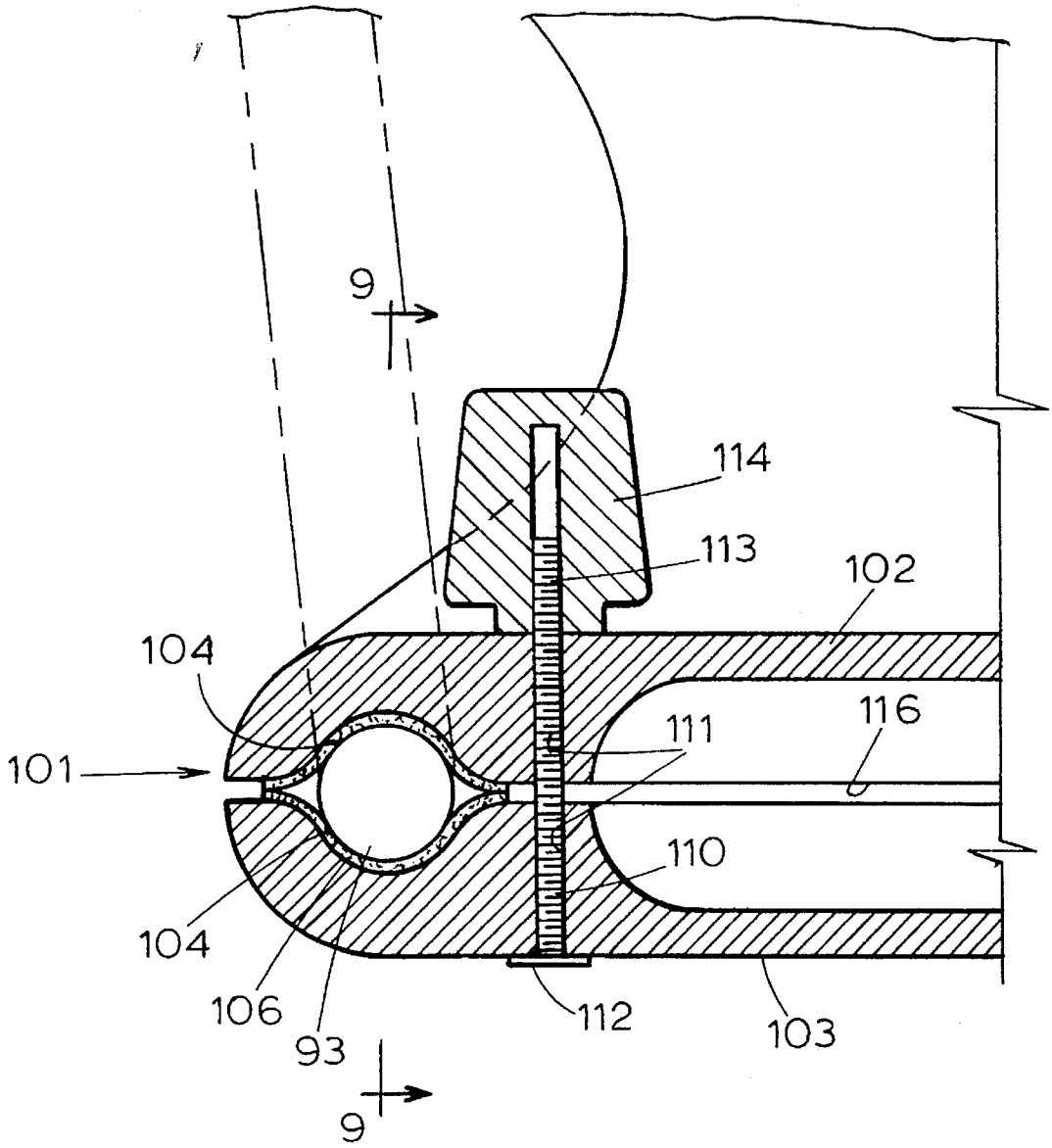
FIG. 8 is a sectional view taken on the line 8—8 of FIG. 7.

A resistance device 101 is also provided for restraining the swinging movement of the seat 86 and also for connecting the center portions 93 and 94 of the two links 91 and 92. The device 101 comprises upper and lower halves 102 and 103 which extend above and below the center portions 93 and 94. At their forward and rearward ends, each of the halves has an arcuate groove 104 formed in it, the grooves 104 of the two halves forming essentially a circle when the two halves are placed together, as illustrated in FIG. 8. The circle has a slightly greater diameter than that of the round center portions 93 and 94. Further, a layer 106 of friction or brake material is located between the center portion 93 of the forward link 91 and the wall of the grooves 104.

The two halves 102 and 103 are held together by a screw 110 (FIGS. 8 and 9) which extends through aligned vertical holes 111 formed through the two halves 102 and 103, close to the forward link 91. In this example, the head 112 of the screw 110 is located underneath the bottom half 103, and the screw 110 is prevented from turning relative to the bottom half 103. The outer end 113 of the screw extends above the upper half 102 and an internally threaded knob 114 is screwed on it.

The two halves 102 and 103 normally have a narrow gap 116 between them, and when the knob 114 is tightened on the screw 110, the gap 116 is narrowed and the halves press the friction layer 106 against the center portion 93 of the link 91. The knob 114 is located near the forward side of the seat 86 where it is readily accessible to a person on the seat.

While friction material may also be placed between the rearward center portion 94 and the halves 102 and 103, this is not normally necessary, and the center portion 94 may be allowed to move freely relative to the halves 102 and 103.

Figure 9:
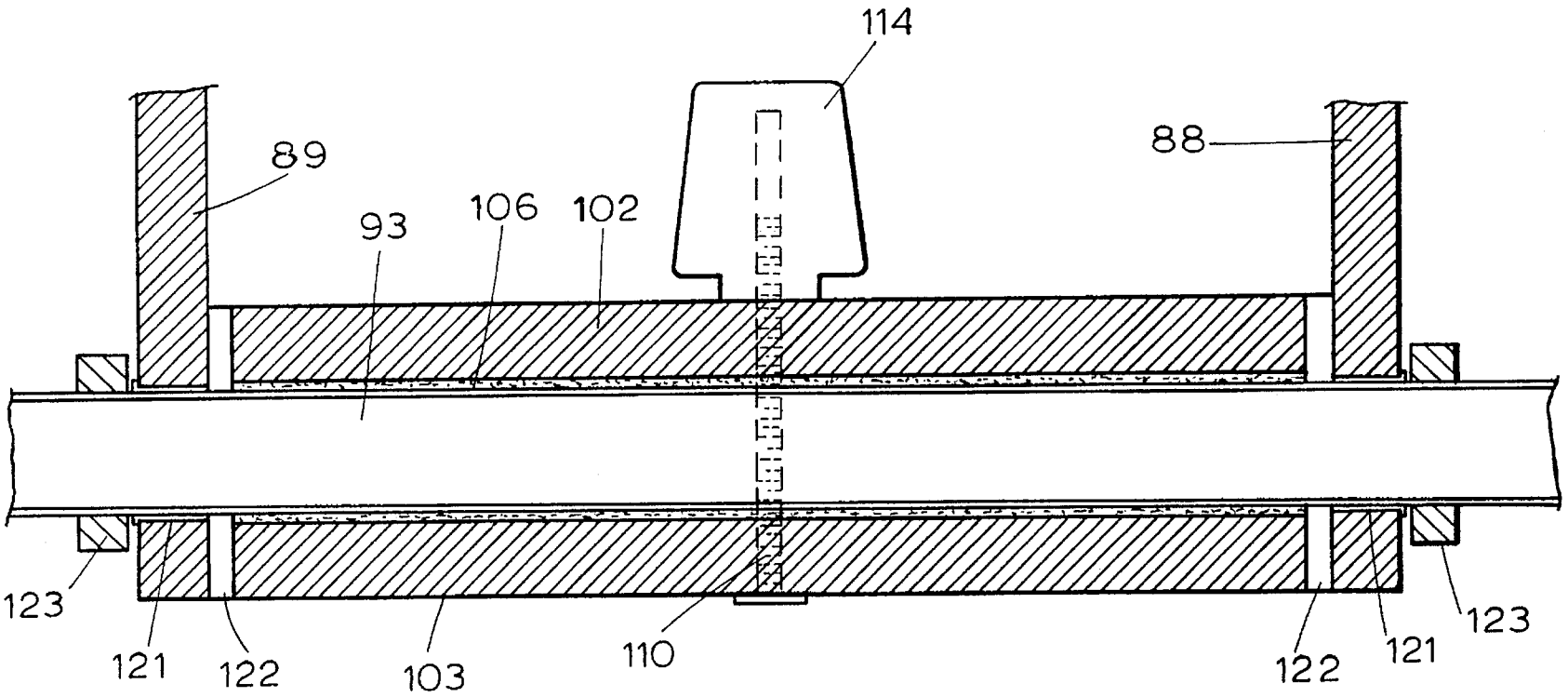
FIG. 9 is a sectional view taken on the line 9—9 of FIG. 8

With reference to FIG. 9, bearing material 121 is provided between the center portions 93 and 94 and the seat supports 88 and 89. Washers 122 are placed between the halves 102 and 103 and the seat supports 88 and 89, and shaft collars 123 are fastened to the center portions 93 and 94 on the outsides of the seat supports 88 and 89.

With reference again to FIG. 6, an adjustable coupling 124 may be provided so that the distance of the foot brace 79 from the seat 86 may be adjusted.

It should be understood that a variety of friction devices may be utilized in an exerciser constructed in accordance with this invention and that the invention does not reside in the specific details of the friction device. While it is preferred that a two-way independent control forward and rearward resistance device is preferred, it may instead be a one-way device.

I claim:

1. An exerciser comprising a) a support base;

b) a seat;

c) pivot link means including upper and lower end portions, said upper end portion being connected to said support base and said lower end portion being connected to said seat, whereby said pivot link means suspends said seat from said support base in rocking motion;

d) resistance means for restraining said rocking motion of said seat relative to said base; and e) manually operated force arm means connected to said pivot means for moving said pivot means to produce said rocking motion.

2. An exerciser as set forth in claim 1, and further including a foot brace attached to said base and extending to a location where a person seated on said seat may brace the feet on said foot brace.

3. An exerciser as set forth in claim 1, wherein said resistance means restrains said rocking motion in two directions.

4. An exerciser as set forth in claim 3, wherein said resistance means is adjustable to vary the magnitude of restraint.

5. An exerciser as set forth in claim 4, wherein said resistance means is adjustable in one direction independently of the adjustment in the other of said two directions.

6. An exerciser as set forth in claim 1, wherein said seat includes a back support.

7. An exerciser comprising a) a support base;

b) a seat;

c) pivot link means including upper and lower end portions, said upper end portion being connected to said support base and said lower end portion being connected to said seat, whereby said pivot link means suspends said seat from said support base in rocking motion;

d) resistance means for restraining said rocking motion of said seat relative to said base; and e) a foot brace attached to said base and extending to a location where a person seated on said seat may brace the feet on said foot brace.

8. An exerciser as set forth in claim 7, and further including manually operated force arm means connected to said pivot means for moving said pivot means to produce said rocking motion.

9. An exerciser as set forth in claim 7, wherein said resistance means restrains said rocking motion in two directions.

10. An exerciser as set forth in claim 9, wherein said resistance means is adjustable to vary the magnitude of restraint.

11. An exerciser as set forth in claim 10, wherein said resistance means is adjustable in one direction independently of the adjustment in the other of said two directions.

12. An exerciser as set forth in claim 7, wherein said seat includes a back support.

13. A rower-type exerciser comprising:

a) a stationary base having forward and rearward ends and two lateral sides, the base including first and second laterally spaced upwardly extending base supports;

b) a seat including seat supports;

c) first and second sets of links, each of said sets including a forward link and a rearward link and each of said links including an upper end portion and a lower end portion;

d) first pivot means for pivotably attaching said upper end portions to said base supports;

e) second pivot means for pivotably attaching said lower end portions to said seat supports;

f) at least one force arm attached to at least one of said forward links and extending forwardly of said seat to a location where it may be grasped by a person mounted on said seat to produce a swinging motion of said seat relative to said base, said exerciser including at least two portions which move relative to each other during said swinging motion; and g) a resistance device connected between said two portions for resisting said swinging motion.

14. A rower-type exerciser as set forth in claim 13, and further including a foot brace attached to said base and extending forwardly of said seat to a location where a person on said seat may brace the feet on said foot brace.

15. A rower-type exerciser as set forth in claim 11, wherein said seat includes a back support.

16. A rower-type exerciser as set forth in claim 13, wherein, for each of said sets, said forward link and said rearward link extend downwardly from said first pivot means to said second pivot means, and said upper end portions are farther apart than said lower end portions whereby said links angle toward each other and produce a tilt of said seat during said swinging motion.

* * * * *